US008988177B1

(12) United States Patent
Dai et al.

(10) Patent No.: US 8,988,177 B1
(45) Date of Patent: Mar. 24, 2015

(54) MAGNETIC CORE HAVING FLUX PATHS WITH SUBSTANTIALLY EQUIVALENT RELUCTANCE

(71) Applicant: Marvell International Ltd., Hamilton (BM)

(72) Inventors: George Shengshi Dai, Sunnyvale, CA (US); Jesus Paz, San Jose, CA (US); Hongyan Li, Shanghai (CN)

(73) Assignee: Marvell International Ltd., Hamilton (BM)

( * ) Notice: Subject to any disclaimer, the term of this patent is extended or adjusted under 35 U.S.C. 154(b) by 0 days.

(21) Appl. No.: 14/292,394

(22) Filed: May 30, 2014

Related U.S. Application Data

(63) Continuation-in-part of application No. 13/850,080, filed on Mar. 25, 2013, now Pat. No. 8,760,249, which is a continuation of application No. 12/614,843, filed on Nov. 9, 2009, now Pat. No. 8,405,478.

(60) Provisional application No. 61/122,526, filed on Dec. 15, 2008, provisional application No. 61/831,303, filed on Jun. 5, 2013.

(51) Int. Cl.
*H01F 3/00* (2006.01)
*H01F 41/02* (2006.01)

(52) U.S. Cl.
CPC ..... *H01F 3/00* (2013.01); *H01F 41/0206* (2013.01)
USPC ..... 335/297; 335/281

(58) Field of Classification Search
USPC ..... 335/297
See application file for complete search history.

(56) References Cited

U.S. PATENT DOCUMENTS

| | | | |
|---|---|---|---|
| 2,300,964 | A | 11/1942 | Putnam |
| 3,878,495 | A | 4/1975 | Thomas |
| 2008/0071260 | A1 | 3/2008 | Shores |

*Primary Examiner* — Shawki S Ismail
*Assistant Examiner* — Lisa Homza

(57) ABSTRACT

Magnetic cores are described that include a first magnetic material with a first magnetic permeability, forming at least part of a body of the magnetic core, and a second magnetic material that has a second magnetic permeability positioned in a corner region of the body of the magnetic core. The second magnetic material is disposed within the body such that a plurality of magnetic flux paths of different overall lengths traverses the corner region. The plurality of potential magnetic flux paths have a corresponding plurality of effective magnetic reluctances, with different paths of the plurality of magnetic flux paths having different associated first lengths of a first plurality of lengths and different associated second lengths of a second plurality of lengths such that the corresponding plurality of magnetic reluctances of the plurality of magnetic flux paths are substantially equivalent through the different overall lengths.

10 Claims, 8 Drawing Sheets

MAGNETIC CORE HAVING FLUX PATHS WITH SUBSTANTIALLY EQUIVALENT RELUCTANCE

CROSS REFERENCE TO RELATED APPLICATIONS

The present disclosure is a continuation-in-part of U.S. patent application Ser. No. 13/850,080, filed Mar. 25, 2013, which is a continuation of U.S. patent application Ser. No. 12/614,843, filed Nov. 9, 2009, now U.S. Pat. No. 8,405,478, issued Mar. 26, 2013, which claims priority to U.S. Patent Application No. 61/122,526, filed Dec. 15, 2008.

The present disclosure also claims priority to U.S. Patent Application No. 61/831,303, filed Jun. 5, 2013.

Each of U.S. patent application Ser. Nos. 13/850,080, 12/614,843, 61/122,526, and 61/831,303 are incorporated herein by reference in their entirety.

TECHNICAL FIELD

Embodiments of the present invention relate to magnetic cores, and more particularly, to increasing energy efficiency of magnetic cores.

BACKGROUND

A magnetic core is a component in a variety of electrical and electromechanical devices including, for example, power generators, motors, transformers or inductors and can be found in Power Generation Sites, transformer substations, power supplies, direct current (DC) converters, refrigerators, air conditioners, vacuum cleaners, fluorescent lamps, and/or electrical cars, as well as a host of other devices. The magnetic core can be used, for example, to concentrate the strength and increase the effect of magnetic fields produced by electric currents and magnets.

FIG. 1 schematically illustrates unevenly distributed magnetic flux 102 in an example magnetic core 100. The magnetic flux 102 is generally more highly concentrated near the inner corner regions 104. The unevenly distributed flux 102 may result in additional generated heat at the corners, which may produce unwanted power loss and/or reduced energy efficiency. The unevenly distributed magnetic flux 102 may be apparent in a variety of cores including gaped/un-gaped magnetic cores or magnetic cores having other shapes or configurations. Magnetic flux is generally concentrated near the higher curvature radius of magnetic core structures resulting in unwanted power loss. For example, a toroid-shaped magnetic core generally has concentrated magnetic flux near an inner radius of the toroid compared to an outer radius of the toroid.

SUMMARY

In some embodiments, the present disclosure provides magnetic cores that include a first magnetic material with a first magnetic permeability, forming at least part of a body of the magnetic core, and a second magnetic material that has a second magnetic permeability positioned in a corner region of the body of the magnetic core. The second magnetic material is disposed within the body such that a plurality of magnetic flux paths of different overall lengths traverse the corner region through a first plurality of lengths of the first magnetic material and a second plurality of lengths of the second magnetic material. The plurality of potential magnetic flux paths have a corresponding plurality of effective magnetic reluctances, with different paths of the plurality of magnetic flux paths having different associated first lengths of the first plurality of lengths and different associated second lengths of the second plurality of lengths such that the corresponding plurality of magnetic reluctances of the plurality of magnetic flux paths are substantially equivalent through the different overall lengths.

In some embodiments, there is an inverse relationship between the plurality of different overall lengths of the plurality of magnetic flux paths that traverse the corner region and corresponding second lengths of the second plurality of lengths of the second magnetic material that the plurality of magnetic flux paths traverse.

In some embodiments, the body of the magnetic core is angled at the corner region at a first angle relative to a leg of the body. The corner region has an angled corner configuration in which an outside edge of the corner region is angled at a second angle relative to the leg of the body, and the second magnetic material has a triangular-shaped cross-sectional area having a straight-line base that is parallel to the outside edge of the corner region.

In some embodiments, the corner region has a rounded corner configuration in which an outside edge of the corner region is rounded, and the second magnetic material has a triangular-shaped cross-sectional area that has a rounded base that is concentric with the outside edge of the corner region.

In some embodiments, the corner region of the body of the magnetic core includes an outside edge angled at 45-degrees with respect to both the back element and the leg element, and an apex of the triangular-shaped cross-sectional area is incidental with the outside edge.

In some embodiments, the present disclosure describes a method of fabricating a magnetic core, including providing a body of a magnetic core that includes a first magnetic material having a first magnetic permeability, and providing a corner element into a corner region of the body of the magnetic core that is comprised of a second magnetic material having a second magnetic permeability. A plurality of magnetic flux paths of different overall lengths traverse the corner region through a first plurality of lengths of the first magnetic material and a second plurality of lengths of the second magnetic material. The plurality of potential magnetic flux paths have a corresponding plurality of effective magnetic reluctances, and the first plurality of lengths and the second plurality of lengths differ among the plurality of magnetic flux paths such that the corresponding plurality of magnetic reluctances of the plurality of magnetic flux paths are substantially equivalent through the different overall lengths.

In some embodiments of the method of fabricating a magnetic core, there is an inverse relationship between the plurality of different overall lengths of the plurality of magnetic flux paths that traverse the corner region and corresponding second lengths of the second plurality of lengths of the second magnetic material that the plurality of magnetic flux paths traverse.

In some embodiments, the method includes providing the body of the magnetic core to include a top portion and a leg portion oriented perpendicular to one another such that the corner region has an outside edge angled with respect to the top portion and the leg portion. A corner is provided with triangular-shaped cross-sectional area with a straight-line base that is parallel to the outside edge.

In some embodiments, the method includes providing the body of the magnetic core to include a top portion and a leg portion oriented perpendicular to one another and such that the corner region has an rounded outside edge, and the method further includes providing the corner element to have a triangular-shaped cross-sectional area having a rounded base that is concentric with the rounded outside edge.

In some embodiments, the corner region of the body of the magnetic core is provided such that an outside edge is angled at 45-degrees with respect to both a back element and a leg element, and an apex of the triangular-shaped cross-sectional area is incidental with the outside edge. In some embodiments the corner element is provided to have a base length that is a function of a difference between the first magnetic permeability and the second magnetic permeability. In some embodiments, the body is provided to have an edge length that is a function of the difference between the first magnetic permeability and the second magnetic permeability.

BRIEF DESCRIPTION OF THE DRAWINGS

Embodiments of the present invention will be readily understood by the following detailed description in conjunction with the accompanying drawings. To facilitate this description, like reference numerals designate like structural elements. Embodiments of the invention are illustrated by way of example and not by way of limitation in the figures of the accompanying drawings.

DETAILED DESCRIPTION OF EMBODIMENTS OF THE INVENTION

The present specification describes configurations and techniques to provide a low-loss magnetic core. In the following detailed description, reference is made to the accompanying drawings which form a part hereof wherein like numerals designate like parts throughout, and in which is shown by way of illustration embodiments in which the invention may be practiced. In general, other embodiments may be utilized and structural or logical changes may be made without departing from the scope of the present invention. Therefore, the following detailed description is not to be taken in a limiting sense, and the scope of embodiments in accordance with the present invention is defined by the appended claims and their equivalents.

The description may use the phrases "in an embodiment," or "in embodiments," which may each refer to one or more of the same or different embodiments. The phrase "in some embodiments" is used repeatedly. The phrase generally does not refer to the same embodiments; however, it may. The terms "comprising," "having," and "including" are synonymous, unless the context dictates otherwise. The phrase "A and/or B" means (A), (B), or (A and B). The phrase "A/B" means (A), (B), or (A and B), similar to the phrase "A and/or B." The phrase "at least one of A, B and C" means (A), (B), (C), (A and B), (A and C), (B and C) or (A, B and C). The phrase "(A) B" means (B) or (A and B), that is, A is optional.

Figure 2A:
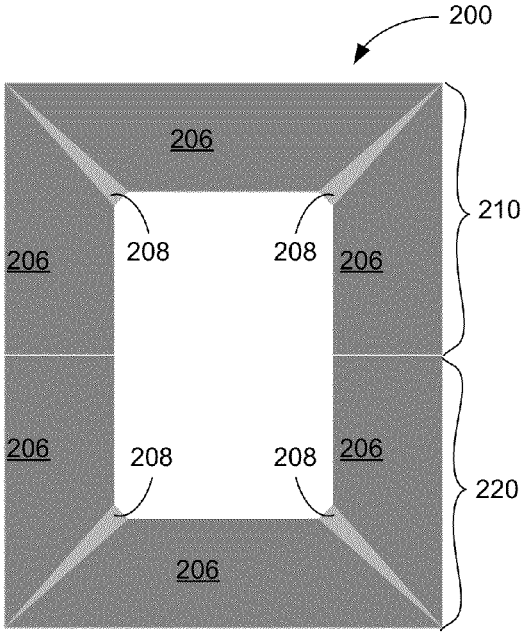
FIG. 2*a* schematically illustrates an example magnetic core, in accordance with various embodiments.

FIG. 2*a* schematically illustrates an example magnetic core 200, in accordance with various embodiments. The illustrated magnetic core 200 comprises a first U-core 210 and a second U-core 220, coupled as shown. In accordance with various embodiments, a magnetic core may include a variety of other shapes and configurations than what is depicted including, for example, C-cores, E-cores, I-cores, toroids, cylinders, rings, beads, planar cores, or other shapes and configurations that may benefit from the principles described herein.

The magnetic core 200 comprises a first magnetic material 206 having a first magnetic permeability to substantially provide a core body of the magnetic core 200. The first magnetic material 206 includes, for example, soft or hard magnetic materials with high magnetic permeability such as soft ferrite, laminated silicon steel, and/or powder iron, or any other magnetic material that may benefit from the principles described herein. The core body generally includes components (e.g., first magnetic material 206 and second magnetic material 208) of the magnetic core 200 that comprise magnetic material to concentrate the strength and/or increase the effect of magnetic fields applied to the magnetic core 200.

The magnetic core 200 further comprises a second magnetic material 208 having a second magnetic permeability that is lower than the first magnetic permeability of the first magnetic material 206. The second magnetic material 208 may be coupled to or positioned in the core body in a manner that substantially evenly distributes magnetic flux in the magnetic core 200. In other words, as used herein substantially evenly distributed magnetic flux means that the magnetic core 200, as well as other magnetic cores according to various embodiments described herein—having a second magnetic material such as the second magnetic material 208 coupled as shown—generally have a more evenly distributed magnetic flux than a magnetic core that solely comprises only one magnetic material, such as magnetic material 206.

Figure 2B:
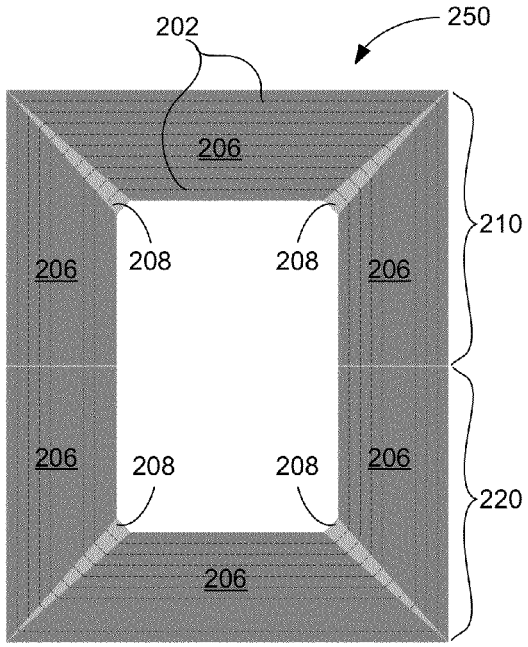
FIG. 2*b* schematically illustrates a substantially evenly distributed magnetic flux in an example magnetic core, in accordance with various embodiments.

FIG. 2*b* schematically illustrates a substantially evenly distributed magnetic flux 202 in an example magnetic core 250, in accordance with various embodiments. The second magnetic material 208 forces a more even distribution of the magnetic flux 202 at the inner corners and the rest of the magnetic core 250 by making a magnetic reluctance associated with different loops or paths of the magnetic flux 202 more similar or substantially the same. In other words, the second magnetic material 208 is generally configured in the core body to provide similar or substantially equal reluctance for different loops of the magnetic flux 202. For example, a magnetic reluctance for an inner loop of the magnetic flux 202 that is closer to the inner corners of the magnetic core 250 may be similar or substantially equal to a magnetic reluctance for an outer loop of the magnetic flux 202 that is closer to the outer corners of the magnetic core 250.

Figure 1:
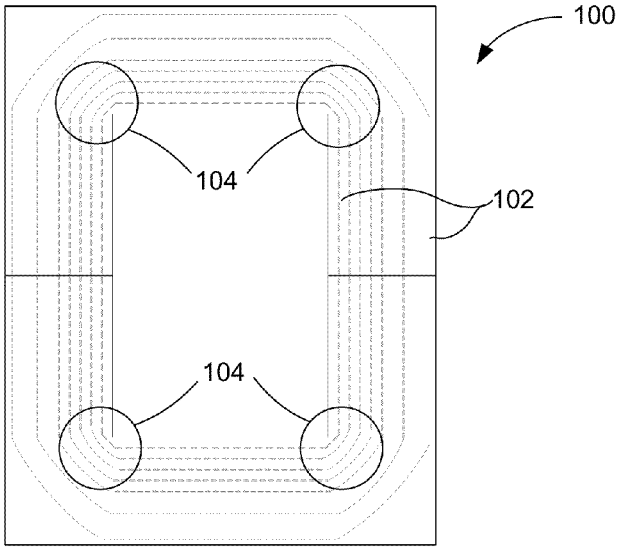
FIG. 1 (PRIOR ART)
FIG. 1 schematically illustrates unevenly distributed magnetic flux in an example magnetic core.

Coupling a lower permeability magnetic material such as the second magnetic material 208 to the first magnetic material 206, as shown, generally reduces or substantially eliminates the localized heating and/or power loss described with respect to the inner corner regions 104 of FIG. 1 and provides a more energy efficient magnetic core 250. Example design principles for the shape and configuration of the second magnetic material 208 are described with respect to FIGS. 3-5.

Figure 3:
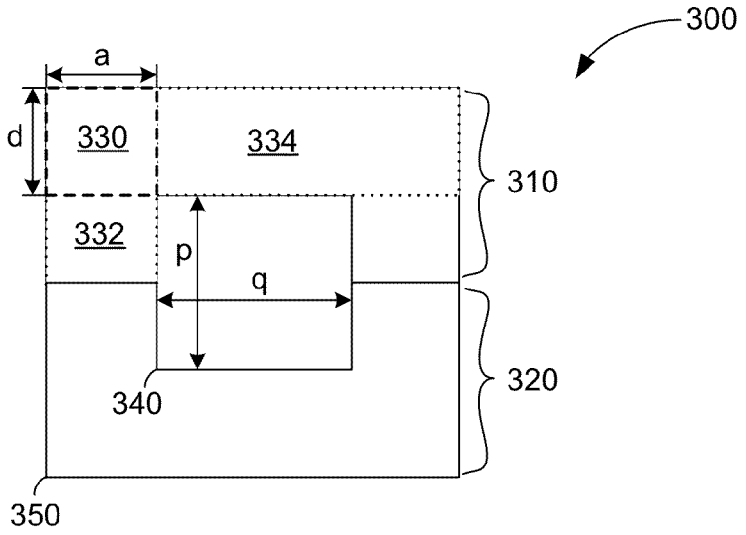
FIG. 3 schematically illustrates a corner region of an example magnetic core, in accordance with various embodiments.

FIG. 3 schematically illustrates a corner region 330 of an example magnetic core 300, in accordance with various embodiments. The magnetic core 300 comprises a first U-core 310 and a second U-core 320, coupled as shown. The magnetic core 300 further includes a corner region 330 defined by a region of the core body where a first portion 332 of the core body meets or coincides with a second portion 334 of the core body in a manner that is substantially perpendicular. The first portion 332 of the U-core 310, for example, coincides with the second portion 334 at the corner region 330 in a manner that roughly forms a right angle where the first portion 332 and the second portion 334 meet. According to various embodiments, the components of the magnetic core 300 may have rounded edges and/or corners without departing from the scope of this disclosure.

The corner region 330 has an area of about axd or slightly larger, where a is a width of the first portion 332 and where d is a width of the second portion 334, as illustrated. An inner perimeter 340 of the magnetic core 300 generally represents a shortest path for magnetic flux and an outer perimeter 350 generally represents a longest path for magnetic flux. The shortest magnetic flux path around the inner perimeter 340 has a distance equal to 2p+2q, where p and q represent the illustrated dimensions associated with the inner perimeter 340. The longest magnetic flux path around the outer perimeter 350 has a distance equal to 4a+4d+2p+2q. An evenly distributed flux can be obtained in the magnetic core 300 by making reluctance for the longest path, the shortest path, and paths in between, substantially similar. The same reluctance for the various paths (e.g., inner perimeter 340 and outer perimeter 350) may be achieved by coupling a lower permeability material at one or more corner regions such as the corner region 330 of the magnetic core 300. An example configuration for coupling a lower permeability material at the corner region 330 is described further with respect to FIG. 4.

Figure 4:
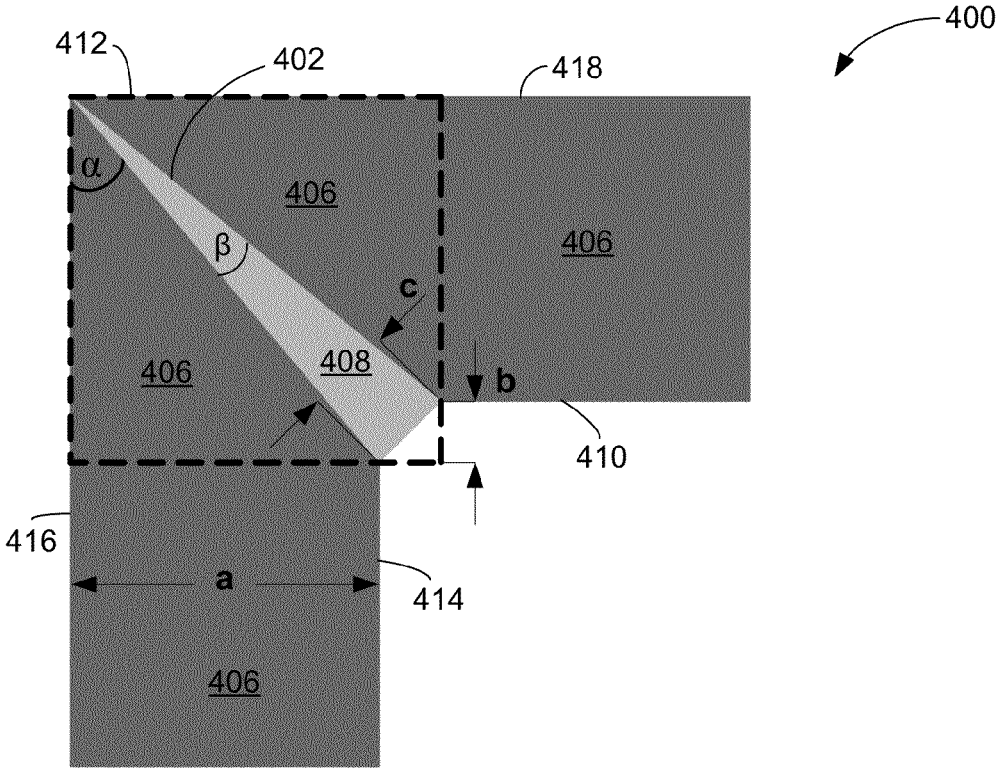
FIG. 4 schematically illustrates an example triangular structure coupled to a core body at a corner region of a magnetic core, in accordance with various embodiments.

FIG. 4 schematically illustrates an example triangular structure 402 coupled to a core body 400 at a corner region 412 (e.g., 330) of a magnetic core (e.g., magnetic core 200 or magnetic core 300), in accordance with various embodiments. The term "coupled to" as used with respect to the triangular structure 402 broadly includes connection relationships such as "physically connected to" or "part of", meaning that the triangular structure 402 may be "formed in", "positioned in", "placed in", or "inserted in" the core body, or other similar meanings. As alluded to earlier, the core body 400 includes a first magnetic material 406 having a first magnetic permeability. The corner region 412 includes the triangular structure 402 comprising a second magnetic material 408 having a second magnetic permeability that is lower than the first magnetic permeability.

According to various embodiments, the triangular structure 402 may be only substantially triangular in form. In other words, the triangular structure 402 may not be an exact triangle, but may include triangular structures having rounded corners, uneven sides, or other deviations from a triangular shape. The term triangular structure 402 is intended to describe a general shape of the second magnetic material 408.

In an embodiment, the triangular structure 402 is an isosceles triangle having a base with length, c, that is positioned near an inner corner of the corner region 412 and having an apex that is positioned near an outer corner of the corner region 412, as illustrated. The base having length, c, may form an angle that is substantially 45° relative to an inner surface (e.g., 410, 414) of the core body 400. An angle, α, defines the angle between an outer surface (e.g., 416, 418) of the first magnetic material 406 and the substantially triangular structure 402, as illustrated.

Distance, b, defines a distance that is normal to an inner surface (e.g., 410) and spans from the inner surface of the first magnetic material 406 to a position where an end of the base having length, c, coincides with an inner surface 414 that is substantially perpendicular to the other inner surface 410, as depicted. The distance, b, may be determined according to the following equation, where a is a width of a portion of the core body 400, cot represents a cotangent function, and where a defines the angle between the outer surface (e.g., 416, 418) of the first magnetic material 406 and the substantially triangular structure 402, as illustrated:

$$b=a*\cot(\alpha)-a=a(\cot(\alpha)-1) \tag{1}$$

For clarity and ease of discussion of the principles described herein, the core body 400 will be described for an example case where distance a of FIG. 3 is equal to distance d of FIG. 3. In such a case, within the corner region 412, the longest distance for magnetic flux is through the first magnetic material 406 around the outer perimeter (e.g., 2*a*) of the core body 400 and the shortest distance for magnetic flux is across the base length (e.g., c) of the triangular structure 402 comprising the second magnetic material 408. The following equations set the shortest path (e.g., c) reluctance to be the same as the longest path reluctance (e.g., 2*a*), and provide a way to calculate the angle α, where $S_{unit_area}$ is a unit cross-section area of the magnetic flux, $\mu_1$ is the magnetic permeability of the first magnetic material 406, and $\mu_2$ is the magnetic permeability of the second magnetic material 408.

$$\frac{2a}{S_{unit_area}\mu_1}=\frac{\sqrt{2}\,a(\cot(\alpha)-1)}{S_{unit_area}\mu_2} \tag{2}$$

becomes $$\cot(\alpha)=\frac{\sqrt{2}\,\mu_2+\mu_1}{\mu_1} \tag{3}$$

becomes $$\alpha=\cot^{-1}\left(\frac{\sqrt{2}\,\mu_2+\mu_1}{\mu_1}\right) \tag{4}$$

Thus, if magnetic permeability for the first magnetic material 406 and the second magnetic material 408 are known, then the angle, α, can be determined. In an embodiment, the first magnetic material 406 comprises ferrite and the second magnetic material 408 comprises iron powder. Subject matter is not limited in this regard, and the first and second magnetic materials (e.g., 406, 408) may include any of a variety of magnetic materials that may benefit from the principles described herein. The base length, c, can be determined according to the following:

$$c = \sqrt{2}\,a(\cot(\alpha) - 1) \tag{5}$$

Equation (5) is reduced to the following using equation (4):

$$c = \frac{2a\mu_2}{\mu_1} \tag{6}$$

An angle, β, of the apex of the triangular structure 402 may be determined according to the following:

$$\beta = 90° - 2\alpha \tag{7}$$

A triangular structure 402 may be implemented in core bodies having other shapes and the triangular structure 402 may be positioned in regions other than the corner region 412 of the core body, according to various embodiments. Such an example is described further with respect to FIG. 5*a*.

Figure 5A:
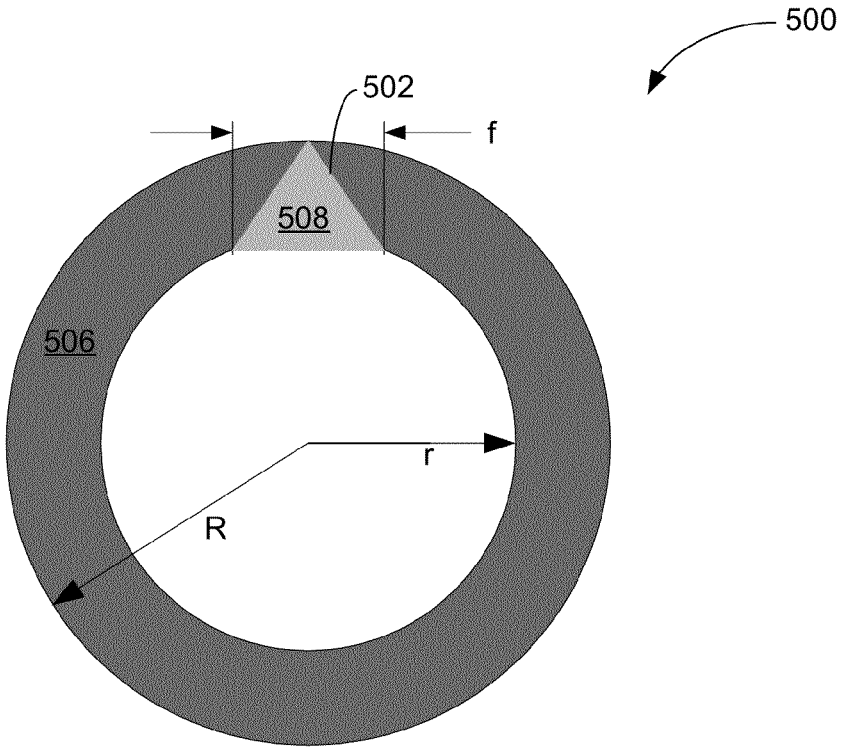
FIG. 5*a* schematically illustrates an example triangular structure coupled to a core body of a toroid-shaped magnetic core, in accordance with various embodiments.

FIG. 5*a* schematically illustrates an example triangular structure 502 coupled to a core body of a toroid-shaped magnetic core 500, in accordance with various embodiments. The magnetic core 500 includes a first magnetic material 506 having a first magnetic permeability and a second magnetic material 508 having a second magnetic permeability that is lower than the first magnetic permeability.

In an embodiment, the second magnetic material 508 forms a substantially triangular structure 502 having a base positioned near an inner radius, r, of the core body and having an apex positioned near an outer radius, R, of the core body. The base length, f, may be determined according to the following, where $\mu_1$ is the magnetic permeability of the first magnetic material 506, and $\mu_2$ is the magnetic permeability of the second magnetic material 508:

$$f = \frac{2\pi(R - r)\mu_2}{\mu_1 - \mu_2} \tag{8}$$

The use of a triangular structure 502 in the magnetic core 500 may make magnetic reluctance the same between the inner radius, r, and the outer radius, R, which may force the magnetic flux to be evenly distributed. The same principle may be applied to other circular-type magnetic cores.

Figure 5B:
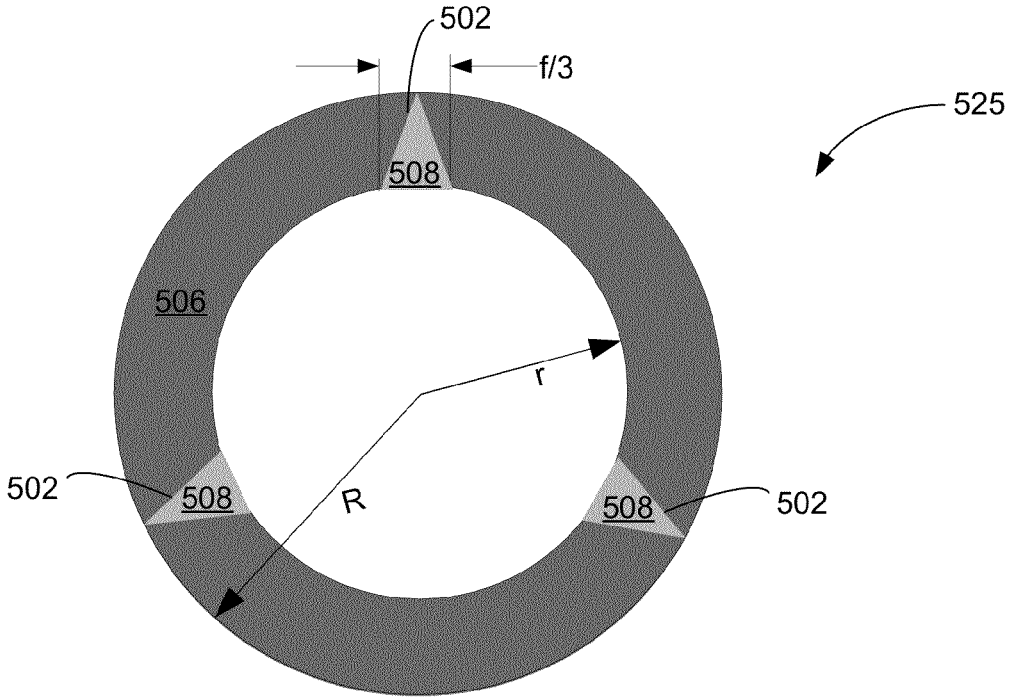
FIG. 5*b* schematically illustrates multiple example triangular structures coupled to a core body of a toroid-shaped magnetic core, in accordance with various embodiments.

FIG. 5*b* schematically illustrates multiple example triangular structures 502 coupled to a core body 506 of a toroid-shaped magnetic core 525, in accordance with various embodiments. In an embodiment, a base length for each of the multiple triangular structures 502, is determined by calculating base length, f, according to equation (8) for a single triangular structure and dividing the base length, f, by the number of triangular structures 502 used. For example, in the illustrated embodiment of FIG. 5*b*, the base length is f/3 for each of the three triangular structures 502. In a case where only two triangular structures are used (not shown), the base length for each triangular structure is f/2. In another case where only four triangular structures are used, the base length for each triangular structure is f/4.

This principle can be used to calculate the base length for any number of triangular structures used to evenly distribute magnetic flux in a circular-type magnetic core. An increasing number of triangular structures may provide more evenly distributed flux distribution, but may cost more to manufacture. A desired number of triangular structures 502 may account for these considerations.

Figure 6:
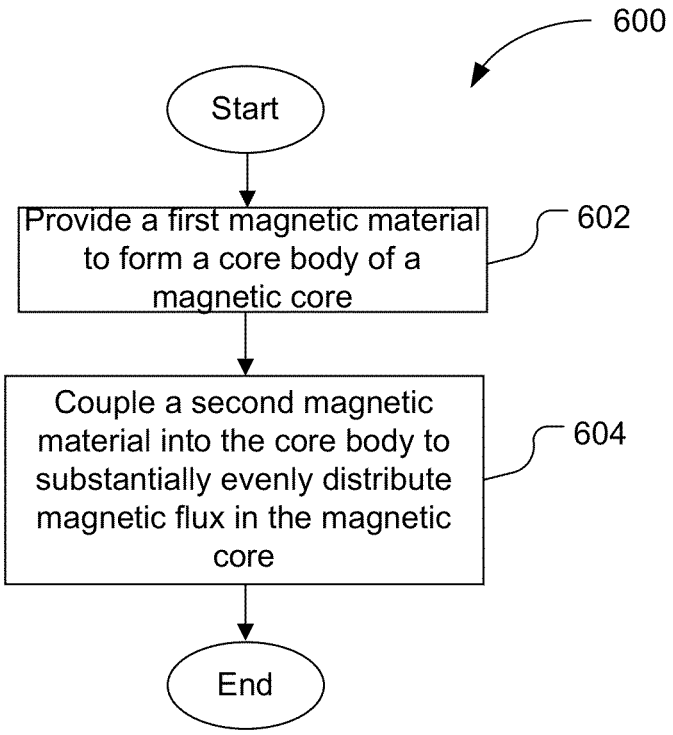
FIG. 6 is a flow diagram of a method to fabricate a magnetic core having a substantially evenly distributed magnetic flux, in accordance with various embodiments.

FIG. 6 is a flow diagram of a method to fabricate a magnetic core having a substantially evenly distributed magnetic flux, in accordance with various embodiments. At block 602, method 600 includes providing a first magnetic material to form a core body of a magnetic core. The first magnetic material comprises a first magnetic permeability and may be used to form a substantial portion of the core body. The magnetic core may be formed according to any suitable well-known process.

According to various embodiments, the first magnetic material is formed into a core of desired shape and then one or more portions of the first magnetic material are removed such that a second magnetic material may be positioned, at block 604, in the core body to substantially evenly distribute the magnetic flux in the magnetic core. In other embodiments, the first magnetic material is formed into a core having vacant regions to anticipate where the second magnetic material is to be placed, at block 604. Other suitable techniques to provide a first magnetic material to form a core body of the magnetic core may be used in other embodiments.

At block 604, a second magnetic material is coupled into the core body to substantially evenly distribute magnetic flux in the magnetic core. The term "couple" as used with respect to coupling the second material into the core body may broadly include connection relationships such as to "physically connect", "become part", "position", "place", "insert", or other similar meanings. The second magnetic material may, for example, first be formed into a triangular structure and then inserted into the core body. In another example, the triangular structure may be formed in place as part of a curing process. In an embodiment, the second magnetic material is formed into a triangular structure first, and then placed into the core body prior to a baking process that cures the magnetic core to reduce manufacturing costs.

The triangular structure may be formed to conform with design principles disclosed herein such as determining a length of a base and/or associated angles of the triangular structure. The triangular structure may be placed in a variety of structures, including a corner region or in a toroid as described herein. Such principles may be applied to other similar shapes and configurations, such as U-cores, C-cores, E-cores, I-cores, toroids, cylinders, rings, beads, planar cores, or other shapes and configurations that may benefit from principles taught in this disclosure.

Additional embodiments are described below in which some magnetic core materials or portions are omitted from corner portions of the magnetic cores. Corner regions of the magnetic cores described below include an angled corner configuration and a rounded corner configuration in which portions of the corner regions are omitted, although embodiments may include other configurations such as a three-sided corner configuration in which an outside edge of the corner includes three straight-line edges each angled 30 degrees from adjacent edge segments. Omitting the portions of the corner regions enables the magnetic cores to be manufactured using less material, resulting in lighter magnetic cores. Since no flux lines would traverse these omitted portions if they were formed as part of the magnetic cores, the omitted portions would be redundant. As with the embodiments described herein with respect to FIGS. 2-6, the magnetic flux paths in the magnetic cores that are described below are substantially uniform, thereby providing relatively higher magnetic core efficiency and heat distribution and reduced power losses of the magnetic core 700 compared with magnetic cores having only one magnetic material or different magnetic materials with different magnetic reluctances. These additional embodiments are applicable to generators, electric motors, inductors, and transformers in electrical power industries. Embodiments are also applicable to high-power industries such as wind power industries, solar power industries; they are also applicable to battery chargers for electric vehicles, and so forth.

Although the embodiments described below are depicted in the figures, and described herein, as being E-cores, magnetic cores according to various embodiments include a variety of other shapes and configurations than what is depicted herein including, for example, C-cores, U-cores, I-cores, or other shapes and configurations that may benefit from the principles described herein.

Figure 7:
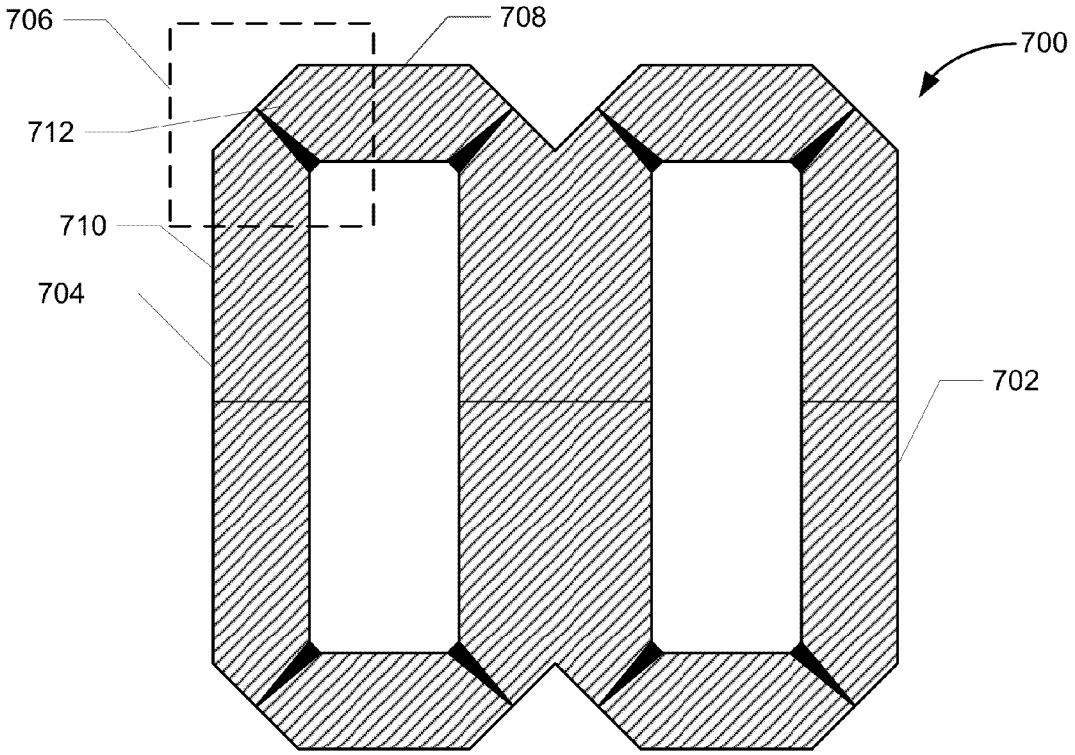
FIG. 7 schematically illustrates an example magnetic core having an angled corner configuration and triangular structures in the corner regions, in accordance with various embodiments.

FIG. 7 schematically illustrates an example magnetic core 700 having an angled corner configuration and triangular structures in the corner regions, in accordance with various embodiments. A body of the magnetic core 700 includes two E-core structures 702 and 704 placed onto one another. The body of the magnetic core 700 includes a corner region 706, a back portion 708, and a leg portion 710, which includes a first magnetic material having a first magnetic permeability. The first magnetic material therefore forms part of a body of the magnetic core 700. The body of the magnetic core 700 has positioned within it a triangular-shaped portion 712, which is composed of a second magnetic material having a second magnetic permeability that is different from the first magnetic permeability. Thus, the corner regions, such as the corner region 706, are comprised of the triangular-shaped portion 712 as well as parts of the back portion 708 and the leg portion 710. Other corner regions of the magnetic core 700 have the same or similar configurations as the corner region 706. In the example illustrated in FIG. 7, the back portion 708 and the leg portion 710 are oriented perpendicular to one another; but embodiments include magnetic cores in which such portions are oriented at other angles with respect to one another. In the example illustrated in FIG. 7 (as well as in the other examples illustrated in the present disclosure, different corner regions of the magnetic cores all have the same angles (e.g., 90 degrees); but different corner regions of the same magnetic cores have, in some embodiments, different angles from one another, such that the magnetic cores have shapes that are deflected, skewed, or otherwise non-uniform. Generally, the angles of the corners of each loop of the magnetic cores sum to 360 degrees. Generally, the bend or angled portions of the magnetic cores according to embodiments include triangular portions similar to or the same as those described herein. The first magnetic material and the second magnetic material include, for example, soft or hard magnetic materials with high magnetic permeability such as soft ferrite, laminated silicon steel, and/or powder iron, or any other magnetic material. Subject matter is not limited in this regard, and the first and second magnetic materials may include any of a variety of magnetic materials that may benefit from the principles described herein.

A plurality of magnetic flux paths of different overall lengths traverses the corner region 706. The magnetic flux paths traverse through different lengths of the first magnetic material and the second magnetic material. In general, and as described in more detail below, the magnetic flux paths having longer lengths through the corner region 706 pass through a relatively shorter length of the lower permeability second magnetic material of the triangular-shaped portion 712 than do the magnetic flux paths with shorter lengths through the corner region 706. Conversely, the magnetic flux paths having longer lengths through the corner region pass through a longer length of the higher permeability magnetic material of the back portion 708 and the leg portion 710. Thus, there is an inverse relationship between the overall length of a magnetic flux path that traverses the corner region 706 and the corresponding length of the second magnetic material that the magnetic flux path traverses.

Figure 8:
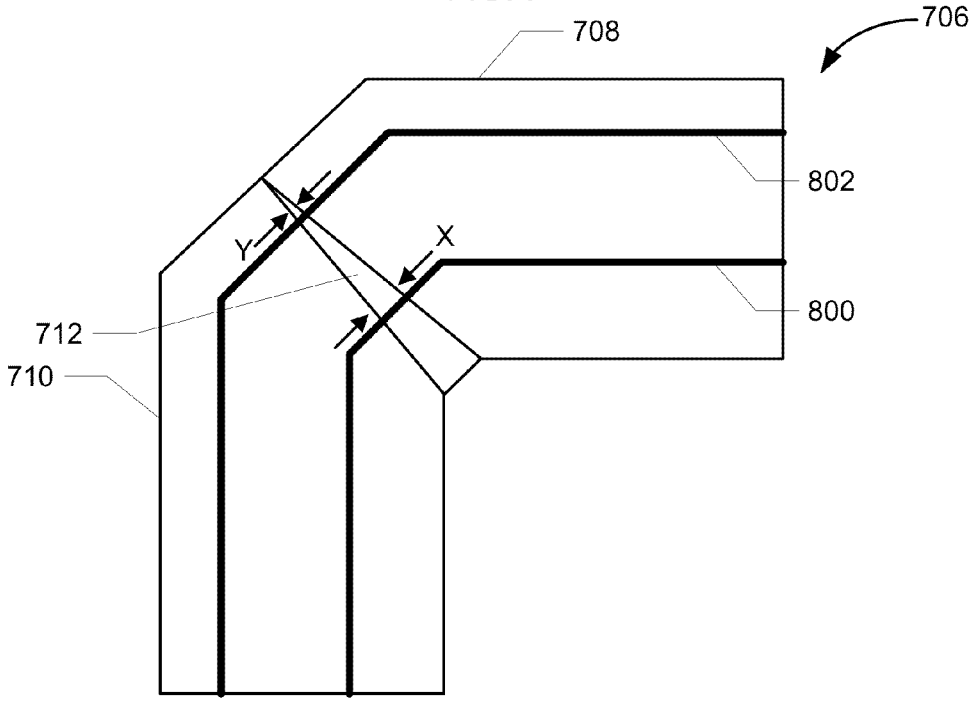
FIG. 8 schematically illustrates a corner region of an example magnetic core having magnetic flux paths of different lengths but substantially equivalent magnetic reluctances.

For example, referring to FIG. 8, magnetic flux path 800 has a shorter overall length through the corner region 706 compared with magnetic flux path 802. But magnetic flux path 800 passes through a relatively long segment X through the triangular portion 712 compared with the segment Y of the triangular portion 712 through which the magnetic path 802 passes. The size and angles of the triangular-shaped portion 712, as well as the relative magnetic permeability of the first and second magnetic materials, result in magnetic flux paths that traverse the corner region 706—such as the magnetic flux paths 800 and 802—having effective magnetic reluctances that are substantially equivalent, or in other words generally more uniform than the magnetic reluctances of the magnetic flux paths in magnetic cores having only one magnetic material or having different magnetic materials with the same magnetic reluctances. The effective magnetic reluctances are functions of the distances and magnetic permeability of the magnetic materials that the flux lines pass through. Thus, by selecting magnetic materials having different magnetic reluctances, and selecting appropriate dimensions and angles for the second magnetic material, the effective magnetic reluctances are substantially similar through the different overall lengths of the magnetic flux paths. And having substantially similar magnetic reluctances results in the magnetic flux lines that are substantially evenly distributed throughout the body of the magnetic core 700, including the corner region 706.

Figure 9:
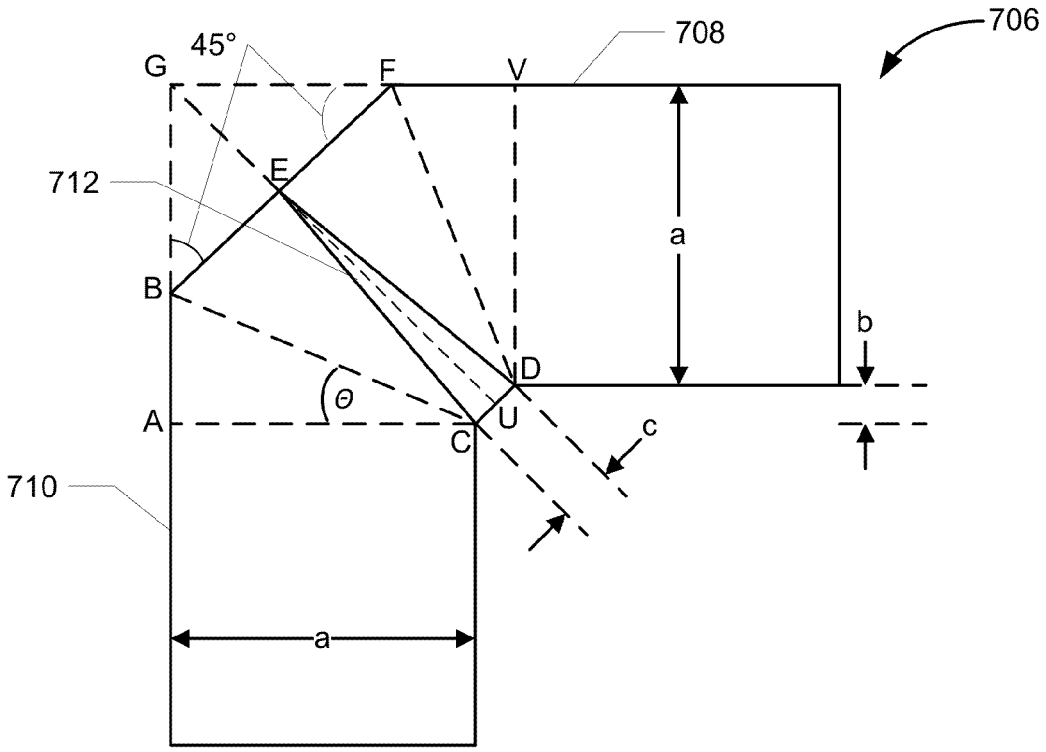
FIG. 9 schematically illustrates a corner region of an example magnetic core having an angled corner configuration.

FIG. 9 schematically illustrates a corner region 706 of an example magnetic core having an angled corner configuration. The corner region 706 has an angled corner configuration in which an outside edge BF of the corner region is angled relative to the leg portion 710 and the back portion 708. In the example shown in FIG. 7, the outside edge BF is angled at 45-degrees with respect to the leg portion 710 (as well as 45-degrees with respect to the back portion 708), although other angles are possible without departing from the scope of the present disclosure.

The triangular-shaped portion 712 has a triangular-shaped cross sectional area with a straight-line base CD that is parallel to the outside edge BF of the corner region 706. Length a is the cross-sectional width of both the back portion 708 and the leg portion 710. Length b is a vertical distance from point C of the triangular-shaped portion 712 to point D of the triangular-shaped portion 712. Length c is the length of a base CD of the triangular-shaped portion 712. The base CD is parallel to the outside edge BF of the corner region 706, and is thus also angled at the same angle as the outer edge BF, e.g., 45-degrees, with respect to the leg portion 710 and the back portion 712. The apex E of the triangular-shaped portion 712 is incidental with the outside edge BF.

A particular design example for a magnetic core having an angled corner configuration is described mathematically below. However, other designs are possible without departing from the scope of embodiments. As will be described below, the length of the base CD, as well as the length of the outer edge BF is, in embodiments, a function of at least the difference between the first magnetic permeability and the second magnetic permeability. The following equations describe the dimensions of the corner region 706.

$$GE = \sqrt{2}(a+b) - a - \frac{b}{\sqrt{2}} = a(\sqrt{2}-1) + b\frac{\sqrt{2}}{2} \tag{9}$$

$$AB=(a+b)-GB \tag{10}$$

becomes $$AB = (a+b) - \sqrt{2}\,GE \tag{11}$$

becomes $$AB = a + b - \sqrt{2}\,a(\sqrt{2}-1) - \sqrt{2}\,b\frac{\sqrt{2}}{2} \tag{12}$$

becomes $$AB = a(\sqrt{2}-1) \tag{13}$$

From equation 13 it follows that:

$$\tan\theta = \frac{a(\sqrt{2}-1)}{a} = \sqrt{2}-1 \tag{14}$$

θ is therefore 22.5 degrees, and is unrelated to the magnetic permeability of the magnetic materials of the magnetic core 700.

So that the effective magnetic reluctances are equivalent along all magnetic flux paths through the corner region 706, the magnetic resistance along triangle base CD is equal to the magnetic resistance of the path along the edge ABFV of the corner region 712. Thus, $$\frac{2(a+b-\sqrt{2}\,GE)+2GE}{\mu_1} = \frac{\sqrt{2}\,b}{\mu_2} \tag{15}$$

$$\frac{4a(\sqrt{2}-1)+b\sqrt{2}}{\mu_1} = \frac{\sqrt{2}\,b}{\mu_2} \tag{16}$$

where $\mu_1$ is the magnetic permeability of the first magnetic material of the body of the magnetic core 700, and $\mu_2$ is the magnetic permeability of the second magnetic material of the triangular-shaped portion 712, and $\mu_1 >> \mu_2$. Based on equation 16, it is possible to extrapolate the length c of the triangle base CD.

$$c = \frac{4(\sqrt{2}-1)a\mu_2}{\mu_1-\mu_2} \tag{17}$$

Using equation 17, the height GE of the omitted triangle portion BGF is calculated as:

$$GE = a(\sqrt{2}-1) + b\frac{\sqrt{2}}{2} = a(\sqrt{2}-1) + \frac{4\sqrt{2}\,a(\sqrt{2}-1)\mu_2}{2*\sqrt{2}(\mu_1-\mu_2)} = \frac{(\sqrt{2}-1)(\mu_1-\mu_2)a}{\mu_1-\mu_2} \tag{18}$$

becomes $$GE = \frac{(2-\sqrt{2})(\mu_1+\mu_2)a}{\mu_1-\mu_2} \tag{19}$$

Using equation 19, the hypotenuse GB of the omitted triangle portion BGF is calculated as:

$$GB = \frac{(\sqrt{2}-1)(\mu_1+\mu_2)a}{\mu_1-\mu_2} \tag{20}$$

Equations 17, 19, and 20 present a design formula for an example corner region 706, including the triangular-shaped portion 712, according to some embodiments of the present disclosure. In one specific example, $\mu_1$=3000 and $\mu_2$=280 and α is 5.9 mm; therefore using equation 17, the length c of the base of the triangular-shaped portion 712 is 1.0 mm. The height UE of the triangular-shaped portion is also α=5.9 mm; the triangular-shaped portion 712 in this specific example is therefore long and narrow. In some embodiments the ratio of the magnetic permeability of $\mu_1$:$\mu_2$ is approximately 10:1, although other ratios of magnetic permeability may be used without departing from the scope of embodiments. The magnetic resistance of the shortest magnetic flux path in the magnetic core 700 is approximately 0.2% greater than in a conventional magnetic core, such as in FIG. 1, having the same overall dimensions and using the first magnetic material having $\mu_1$. However, overall efficiency of the magnetic core 700 is increased over conventional designs by many percentage points.

The magnetic lines of force (magnetic flux paths) in the corner region 706, which are parallel to one another, rotate to the right by 45-degrees at diagonal line BC, the magnetic flux paths then penetrate the second magnetic material of the triangular-shaped portion 712 following this direction, and then rotate to the right by another 45-degrees at a second diagonal line FD and change to the horizontal direction at the diagonal line FD. Because of the parallel nature of the magnetic flux paths, and because the magnetic reluctances of the magnetic flux paths are equivalent or substantially equivalent, the magnetic flux paths will be evenly or substantially evenly distributed along the widths a of the corner region 706. Because the magnetic flux paths in the non-corner portions of the magnetic core 700 also have magnetic reluctances that are equivalent or substantially equivalent magnetic resistances, the magnetic flux paths will be evenly or substantially evenly distributed throughout the entire magnetic core 700.

Figure 10:
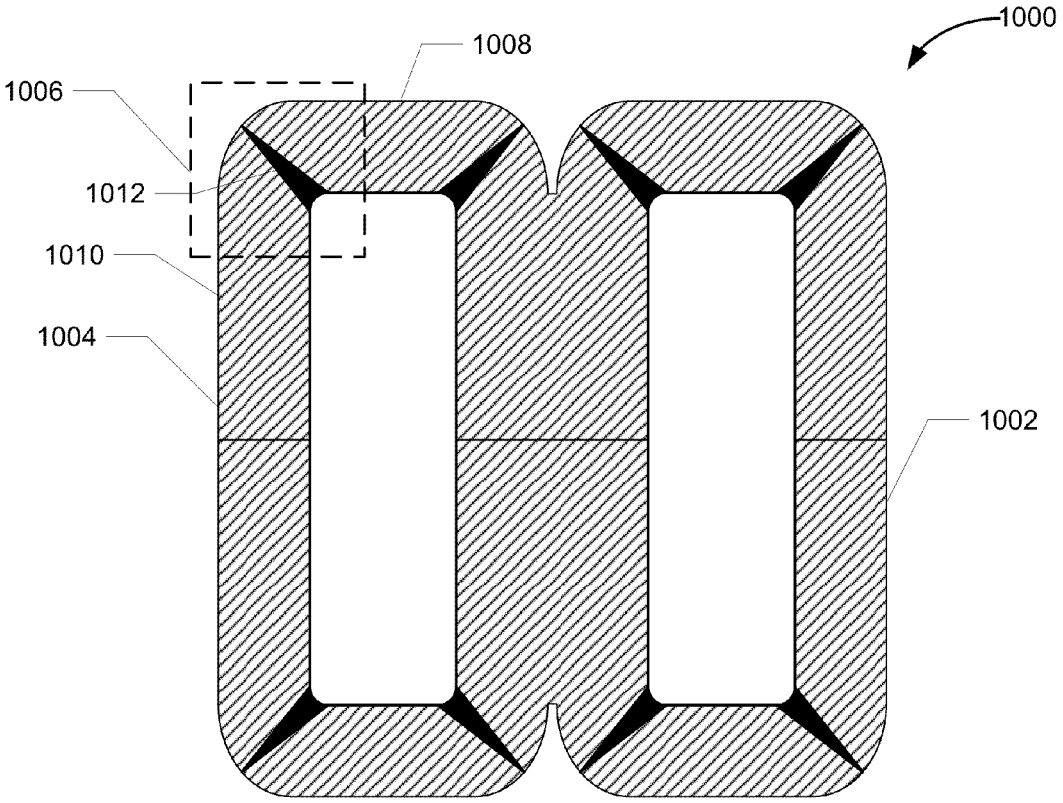
FIG. 10 schematically illustrates an example E-shaped magnetic core having a rounded corner configuration and triangular structures in the corner regions, in accordance with various embodiments.

FIG. 10 schematically illustrates an example E-shaped magnetic core 1000 having a rounded corner configuration and triangular structures in the corner regions, in accordance with various embodiments. A body of the magnetic core 1000 includes two E-core structures 1002 and 1004 placed onto one another. The body of the magnetic core 1000 includes a corner region 1006, a back portion 1008, and a leg portion 1010, which include a first magnetic material having a first magnetic permeability. The first magnetic material therefore at least partly forms a body of the magnetic core 1000. The body of the magnetic core 1000 has positioned within it a triangular-shaped portion 1012, which is composed of a second magnetic material having a second magnetic permeability that is different from the first magnetic permeability. Thus, the corner portions, such as the corner region 1006, are comprised of the triangular-shaped portion 1012 as well as parts of the back portion 1008 and the leg portion 1010. Other corner regions of the magnetic core 1000 have the same or similar configurations as the corner region 1006. In the example illustrated in FIG. 10, the back portion 1008 and the leg portion 1010 are oriented perpendicular to one another; but embodiments include magnetic cores in which such portions are oriented at other angles with respect to one another.

The triangular-shaped portion 1012 has a rounded base that is concentric with the rounded outside edge of the corner region 1006. The principle of operation of the magnetic core 1000 is similar to the principle of operation of the magnetic core 700; in particular, the magnetic flux paths through the corner regions—such as the corner region 1006—have magnetic reluctances that are equivalent or substantially equivalent. Thus, the distribution of the magnetic flux paths will be evenly or substantially evenly distributed through the corner region 1006. And because the magnetic flux paths will have equivalent or substantially equivalent magnetic reluctances through the non-corner portions of the magnetic core 1000, the magnetic flux paths will be evenly distributed throughout the body of the magnetic core 1000 and the efficiency of operation of the magnetic core 1000 is improved over conventional magnetic cores of similar configuration (e.g., conventional E-cores).

Figure 11:
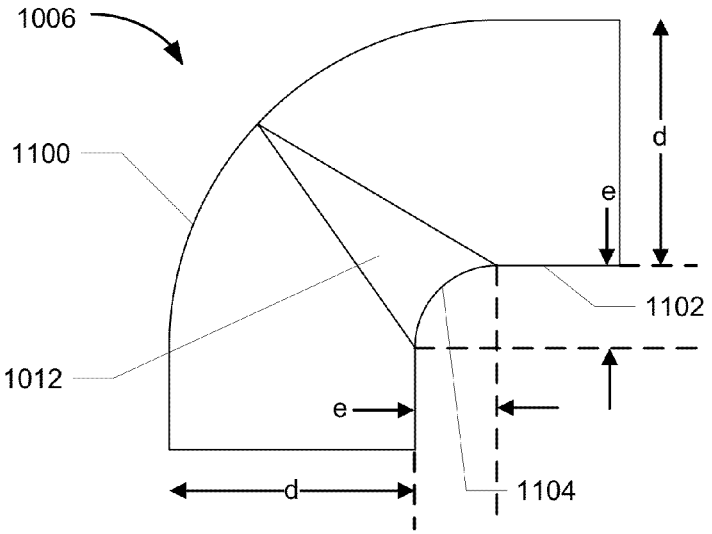
FIG. 11 schematically illustrates a corner region of an example magnetic core 1000 having a rounded corner configuration.

FIG. 11 schematically illustrates a corner region 1006 of an example magnetic core 1000 having a rounded corner configuration. The corner region 1006 has an outside edge 1100 and inside edge 1102, which includes the rounded base 1104 of the triangular-shaped portion 1012. The outside edge 1100 and the rounded base 1104 are concentric one quarter circular arcs. The radius of circular arc of the outside edge 1100 is d+e, and the radius of the circular arc of the inside edge is e, where d is the width of the back portion 1008 and the width of the leg portion 1010, and where:

$$e = \frac{d\mu_2}{\mu_1 - \mu_2} \tag{21}$$

Where $\mu_1$ is the magnetic permeability of the first magnetic material and $\mu_2$ is the magnetic permeability of the second magnetic material of which the triangular-shaped portion 1012 is composed.

The magnetic cores 700 and 1000 in FIGS. 7-11 are illustrated as having triangular-shaped corner portions that are comprised of a second magnetic material with lower permeability than the first magnetic material that is included in the magnetic cores, and that have a straight-line or curved bases along the inner surface of the corner region and apexes that are incidental with an outside edge of the corner region. But magnetic cores may have other configurations without departing from the scope of embodiments. For example, corner regions of magnetic cores according to some embodiments include triangular-shaped corner portions, comprised of a higher permeability magnetic material than the magnetic material that is included the body of the magnetic core, with bases that form parts of the outside surfaces of the corner regions and apexes that are incidental with the inner surfaces of the corner regions. Other example configurations include corner regions having more than one triangular-shaped corner portion in a single corner region. Still other examples include magnetic cores having corner portions with outside and/or inside edges that are curved but not perfectly circular or that are either more or less than quarter circles, and so forth. Some magnetic cores according to some embodiments include corner regions with curved outside surfaces and angled but straight-line inner surfaces, which have a similar principal of operation as the magnetic cores illustrated in FIGS. 3-11. Similarly, magnetic cores include corner portions with angled, straight-line outside surfaces and curved inner surfaces without departing from the scope of embodiments.

Figure 12:
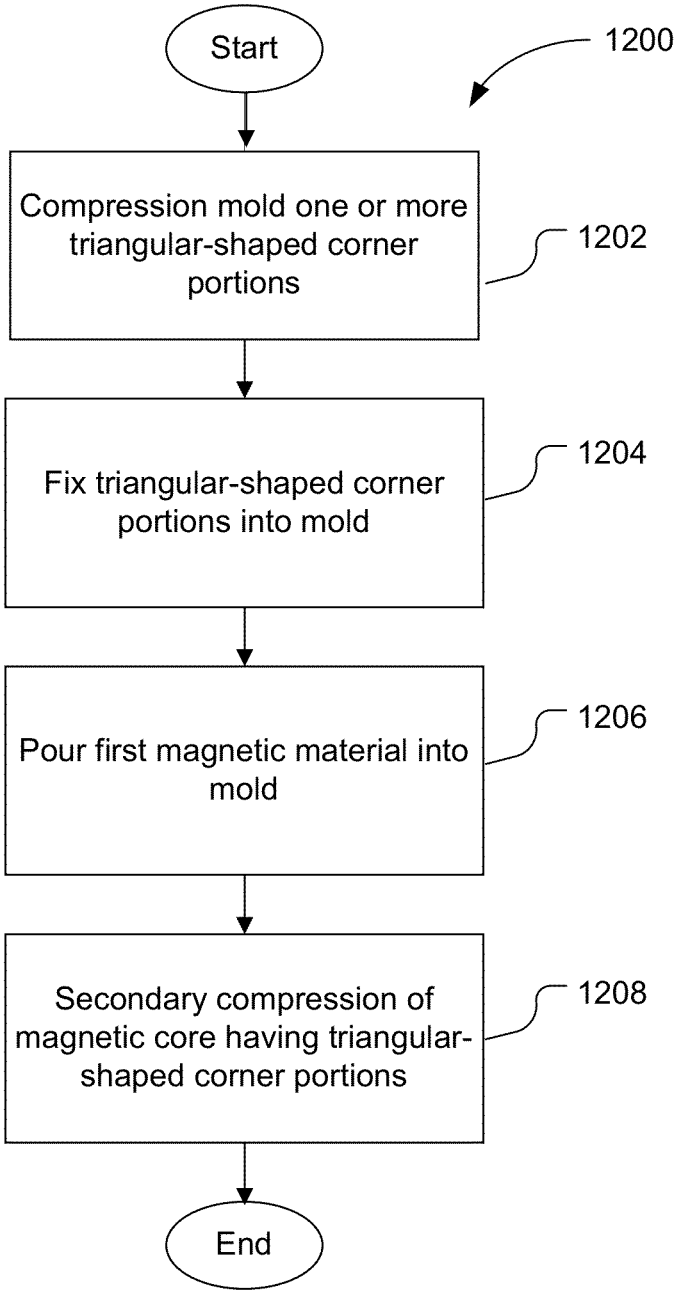
FIG. 12 is a flow diagram of a method to fabricate a magnetic core having an angled configuration or a rounded corner configuration.

FIG. 12 is a flow diagram of a method 1200 to fabricate a magnetic core having an angled configuration or a rounded corner configuration. At 1202, one or more triangular-shaped corner portions, such as the corner portions 402, 502, 712, and 1012, are compression molded. For example, to mold the magnetic core 700, eight triangular-shaped corner portions are compression molded.

At 1204, the one or more triangular-shaped corner portions are fixed into the corner regions of a core mold, such as a conventional E-core, U-core, or other core type mold. Where angled or rounded corner configurations are desired, as with magnetic cores 700 and 1000, either the mold is modified (or special-built) to produce the angled or rounded corner regions, or additional mold pieces are added to the mold at the corner regions to prevent magnetic material from forming the omitted portions of the core.

At 1206, the first magnetic material, as described above, is poured into the mold having the fixed triangular-shaped corner portions in the corner regions. At 1208, a secondary compression is performed to produce the magnetic core having the triangular-shaped corner portions as described here, according to various embodiments.

Various operations may have been described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

Although certain embodiments have been illustrated and described herein, a wide variety of alternate and/or equivalent embodiments or implementations calculated to achieve the same purposes may be substituted for the embodiments illustrated and described without departing from the scope of the present invention. This application is intended to cover any adaptations or variations of the embodiments discussed herein. Therefore, it is manifestly intended that embodiments in accordance with the present invention be limited only by the claims and the equivalents thereof.

What is claimed is:

1. A magnetic core comprising:

a first magnetic material having a first magnetic permeability, wherein the first magnetic material forms at least part of a body of the magnetic core; and a second magnetic material (i) that has a second magnetic permeability and (ii) that is positioned in a corner region of the body of the magnetic core, wherein the second magnetic material is disposed within the body such that a plurality of magnetic flux paths of different overall lengths traverses the corner region through (i) a first plurality of lengths of the first magnetic material and (ii) a second plurality of lengths of the second magnetic material, wherein the body of the magnetic core includes (i) a back element and (ii) a leg element, the leg element oriented perpendicular to the back element, the corner region of the body of the magnetic core further includes a corner element that (i) is comprised of the second magnetic material and (ii) has a triangular-shaped cross-sectional area that has a base, the corner element is oriented such that the base is angled at 45-degrees with respect to both (i) the back element and (ii) the leg element, the corner region of the body of the magnetic core includes an outside edge angled at 45-degrees with respect to both (i) the back element and (ii) the leg element, an apex of the triangular-shaped cross-sectional area is incidental with the outside edge, a base length of the base is a function of at least a difference between (i) the first magnetic permeability and (ii) the second magnetic permeability, the plurality of potential magnetic flux paths has a corresponding plurality of effective magnetic reluctances, and different paths of the plurality of magnetic flux paths have (i) different associated first lengths of the first plurality of lengths and (ii) different associated second lengths of the second plurality of lengths such that the corresponding plurality of magnetic reluctances of the plurality of magnetic flux paths are substantially equivalent through the different overall lengths.

2. The magnetic core of claim 1, wherein there is an inverse relationship between (i) the plurality of different overall lengths of the plurality of magnetic flux paths that traverse the corner region and (ii) corresponding second lengths of the second plurality of lengths of the second magnetic material that the plurality of magnetic flux paths traverse.

3. The magnetic core of claim 1, wherein an edge length of the outside edge is a function of at least the difference between (i) the first magnetic permeability and (ii) the second magnetic permeability.

4. The magnetic core of claim 1, wherein the base length is given by the equation where c is the base length, a is a cross-sectional width of one or both of (i) the back element or (ii) the leg element, $\mu_1$ is the first magnetic permeability, and $\mu_2$ is the second magnetic permeability.

5. The magnetic core of claim 1, wherein a ratio of the first magnetic permeability to the second magnetic permeability is approximately 10:1.

6. A method of fabricating a magnetic core, wherein the method comprises:

providing a body of a magnetic core, wherein the body of the magnetic core includes a first magnetic material having a first magnetic permeability, and providing a corner element into a corner region of the body of the magnetic core, wherein the corner element is comprised of a second magnetic material having a second magnetic permeability, providing the body of the magnetic core to include (i) a back element and a (ii) leg element, wherein the leg element is oriented perpendicular to the back element, providing the corner element to have a triangular-shaped cross-sectional area having a base, wherein the corner element is oriented with respect to the body such that the base is angled at 45-degrees with respect to both (i) the back element and (ii) the leg element, wherein a plurality of magnetic flux paths of different overall lengths traverse the corner region through (i) a first plurality of lengths of the first magnetic material and (ii) a second plurality of lengths of the second magnetic material, the plurality of potential magnetic flux paths have a corresponding plurality of effective magnetic reluctances, the first plurality of lengths and the second plurality of lengths differ among the plurality of magnetic flux paths such that the corresponding plurality of magnetic reluctances of the plurality of magnetic flux paths are substantially equivalent through the different overall lengths, the corner region of the body of the magnetic core includes an outside edge angled at 45-degrees with respect to both (i) the back element and (ii) the leg element, and wherein an apex of the triangular-shaped cross-sectional area is incidental with the outside edge, and the method further comprises providing the corner element to have a base length of the base that is a function of a difference between (i) the first magnetic permeability and (ii) the second magnetic permeability.

7. The method of claim 6, further comprising providing (i) the first magnetic material and (ii) the second magnetic material such that there is an inverse relationship between (i) the plurality of different overall lengths of the plurality of magnetic flux paths that traverse the corner region and (ii) corresponding second lengths of the second plurality of lengths of the second magnetic material that the plurality of magnetic flux paths traverse.

8. The method of claim 6, further comprising providing the body to have an edge length of the outside edge that is a function of the difference between (i) the first magnetic permeability and (ii) the second magnetic permeability.

9. The method of claim 6, further comprising providing the corner element to have the base length given by the equation $$c = \frac{4(\sqrt{2}-1)a\mu_2}{\mu_1 - \mu_2},$$

where c is the base length, a is a cross-sectional width of one or both of (i) the back element or (ii) the leg element, $\mu_1$ is the first magnetic permeability, and $\mu_2$ is the second magnetic permeability.

10. The method of claim 6, wherein:

the first magnetic material comprises ferrite; and the second magnetic material comprises iron powder.

* * * * *